US010371480B1

(12) United States Patent
Huang

(10) Patent No.: US 10,371,480 B1
(45) Date of Patent: Aug. 6, 2019

(54) RETENTION OF A LARGE DIAMETER AXLE ON AN ARCHERY BOW LIMB

(71) Applicant: Dorge O. Huang, Henry, IL (US)

(72) Inventor: Dorge O. Huang, Henry, IL (US)

( * ) Notice: Subject to any disclaimer, the term of this patent is extended or adjusted under 35 U.S.C. 154(b) by 108 days.

(21) Appl. No.: 15/587,755

(22) Filed: May 5, 2017

Related U.S. Application Data

(63) Continuation-in-part of application No. 15/172,522, filed on Jun. 3, 2016.

(51) Int. Cl.
*F41B 5/10* (2006.01)
*F41B 5/00* (2006.01)

(52) U.S. Cl.
CPC ..... *F41B 5/105* (2013.01); *F41B 5/00* (2013.01); *F41B 5/10* (2013.01)

(58) Field of Classification Search
None
See application file for complete search history.

(56) References Cited

U.S. PATENT DOCUMENTS 3,645,591 A * 2/1972 Winberg ..... E21B 10/10 384/481
3,679,009 A * 7/1972 Goodfellow ..... E21B 10/10 175/364
3,705,750 A * 12/1972 Crow ..... E21B 10/10 175/364
3,752,243 A * 8/1973 Hummer ..... E21B 10/10 175/364
3,858,670 A * 1/1975 Ott ..... E21B 10/10 175/374
3,923,035 A * 12/1975 Trotter ..... F41B 5/10 124/25.6
4,241,799 A * 12/1980 Going, III ..... E21B 7/28 175/361
4,561,413 A * 12/1985 Jennings ..... F41B 5/105 124/25.6
4,770,154 A * 9/1988 Cook ..... F41B 5/10 124/25.6
5,307,787 A * 5/1994 LaBorde ..... F41B 5/105 124/25.6
5,697,355 A * 12/1997 Schaffer ..... F41B 5/10 124/25.6
6,516,790 B1 * 2/2003 Darlington ..... F41B 5/10 124/25.6
8,528,534 B2 * 9/2013 McPherson ..... F41B 5/14 124/25.6
9,115,953 B1 * 8/2015 Huang ..... F41B 5/10
9,683,806 B1 * 6/2017 Yehle ..... F41B 5/105

* cited by examiner

*Primary Examiner* — Melba Bumgarner
*Assistant Examiner* — Amir A Klayman
(74) *Attorney, Agent, or Firm* — Donald J. Ersler

(57) ABSTRACT

Retention of a large diameter axle on an archery bow limb preferably includes a limb axle. A tubular limb axle may be attached to either twin limbs or a split limb. At least one spacer may be inserted into the tubular limb. An end of the twin or split limb may be modified to have the same shape as the at least one spacer. Attachment of the tubular limb axle and the at least one spacer to the twin or split limbs may be implemented with adhesive, glue, cement or any suitable bonding substance. The tubular limb axle and at least one spacer may also be attached to twin or split limbs with at least one fastener.

11 Claims, 10 Drawing Sheets

RETENTION OF A LARGE DIAMETER AXLE ON AN ARCHERY BOW LIMB

CROSS-REFERENCES TO RELATED APPLICATIONS

This is a continuation-in-part patent claiming the benefit of application Ser. No. 15/172,522, filed on Jun. 3, 2016.

BACKGROUND OF THE INVENTION

Field of the Invention

The present invention relates generally to archery and more specifically to retention of a large diameter axle on an archery bow limb, which prevents twisting of a cam or the like relative to the limb.

Discussion of the Prior Art

It appears that the prior art does not teach or suggest a cam being pivotally supported by a large diameter axle retained on an archery bow limb. The diameter of a typical cam axle is about 3 mm. The small diameter of 3 mm is susceptible to twisting, when an arrow is shot from the archery bow. Increasing a diameter of the cam axle will prevent twisting thereof. It is preferable that the axle has a diameter of about 11-12 mm.

Accordingly, there is a clearly felt need in the art for retention of a large diameter axle on an archery bow limb, which prevents twisting of an axle relative to a limb; reduces twisting of the limb; and allows the limb to be thinned to reduce weight.

SUMMARY OF THE INVENTION

The present invention provides retention of a large diameter axle on an archery bow limb, which allows decreasing the weight of the limb. The retention of a large diameter axle on an archery bow limb includes a limb axle. The limb axle may be tubular and include an inner perimeter. If the limb axle is tubular, at least one slot is cut in opposing ends of the limb axle to receive twin limbs or two limb projections of a split limb. If the limb axle is tubular, top and bottom spacers are required to prevent damage to the limb projections. A fastener or the like is preferably used to retain the tubular limb axle on each limb projection. If the limb is not tubular, a limb pocket is cut in opposing ends of the limb axle to receive the twin limbs or two limb projections. A fastener or the like is preferably used to retain the limb axle on each limb projection.

A tubular limb axle may be attached to either twin limbs or a split limb. At least one spacer may be inserted into the tubular limb. An end of the twin or split limb may be modified to have the same shape as the at least one spacer. Attachment of the tubular limb axle and the at least one spacer to the twin or split limbs may be implemented with adhesive, glue, cement or any similar bonding substance. The tubular limb axle and at least one spacer may also be attached to twin or split limbs with at least one fastener.

Accordingly, it is an object of the present invention to provide a limb axle, which prevents twisting of a cam axle relative to the limb.

It is another object of the present invention to provide a limb axle, which reduces twisting of the limb.

Finally, it is another object of the present invention to provide a limb axle, which allows the limb to be thinned to reduce weight.

These and additional objects, advantages, features and benefits of the present invention will become apparent from the following specification.

DETAILED DESCRIPTION OF THE PREFERRED EMBODIMENTS

Figure 1:
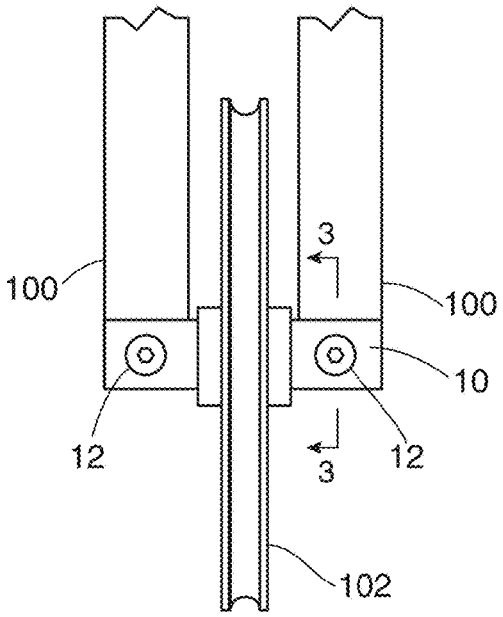
FIG. 1 is a top view of a limb axle attached to a twin limb in accordance with the present invention.
Figure 2:
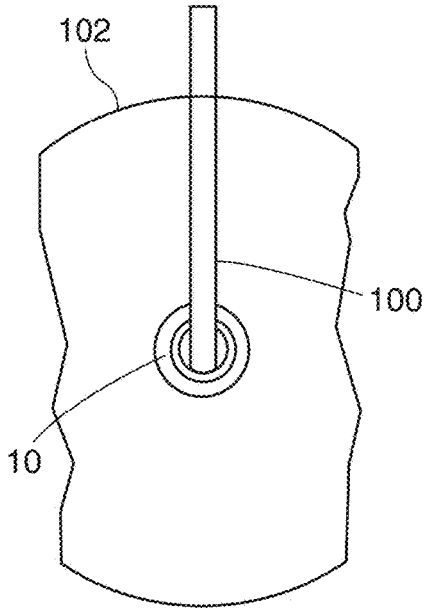
FIG. 2 is a side view of a tubular limb axle attached to a twin limb in accordance with the present invention.
Figure 3:
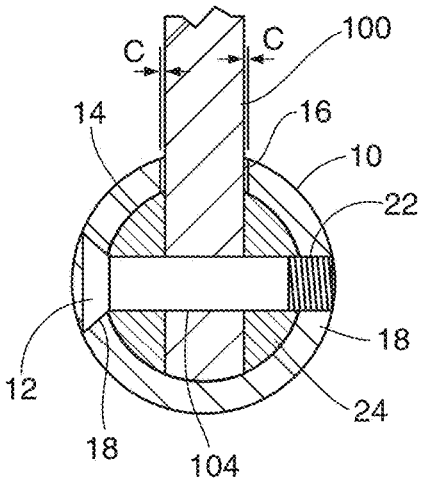
FIG. 3 is an enlarged cross sectional side view cut through FIG. 1 of a tubular limb axle attached to a twin limb with two spacers in accordance with the present invention.
Figure 4:
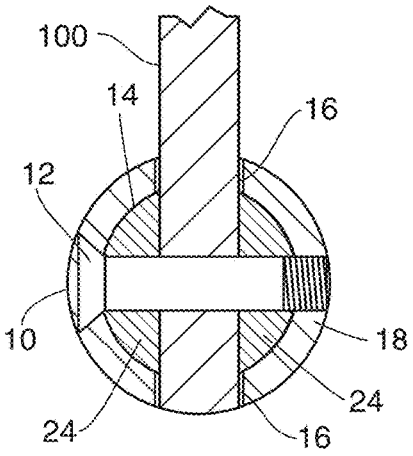
FIG. 4 is an enlarged cross sectional side view of a tubular limb axle with a slot cut in opposing side walls with two spacers in accordance with the present invention.
Figure 5:
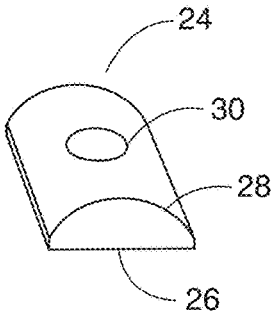
FIG. 5 is a perspective view of a spacer used with a tubular limb axle in accordance with the present invention.

With reference now to the drawings, and particularly to FIG. 1, there is shown a top view of a limb axle 10. With reference to FIG. 2, the limb axle 10 preferably includes a round outer diameter. The limb axle 10 is preferably secured to an end of twin limbs 100 or two limb members of a split limb with a pair of fasteners 12. It is preferable to use a flat head screw to secure the limb axle 10 to the pair of limb members, but other fastening devices may also be used, such as rivets or pins. An archery cam 102, a pulley or the like is rotatably retained on the limb axle 10. With reference to FIGS. 3-4, the limb axle 10 is tubular and includes an inner perimeter 14. With reference to FIG. 3, an end slot 16 is cut into a single side wall 18 in opposing ends of the limb axle 10 to receive the twin limbs 100. With reference to FIG. 4, the end slot 16 is cut into opposing side walls 18 in opposing ends of the limb axle 10 to receive the twin limbs 100. A countersunk hole 20 is formed through one surface of a side wall 18 of the limb axle 10 and a threaded hole 22 is formed through an opposing surface of the side wall 18. A clearance hole 104 is formed through each limb 100. The fastener 12 is inserted through the countersunk hole 20 and the clearance hole 104 and tightened in the threaded hole 22. However, the threaded hole 22 may be replaced with a clearance hole, a longer fastener and a threaded nut.

The limb axle 10 requires a pair of spacers 24 to prevent damage to the twin limbs 100. Each spacer 24 includes a flat bottom surface 26, a curved top surface 28 and a clearance hole 30. The curved top surface 28 is sized to be received by the inner perimeter 14. The clearance hole 30 is formed through the spacer 24 to receive fastener 12. It is preferable to secure the pair of spacers 24 to the twin limbs 100 with adhesive, cement, glue or any other suitable substance. It is preferable to fabricate the pair of spacers 24 from a soft material, such as plastic or rubber. It is necessary to have a clearance "C" between the two end slots 16 and the pair of limb members to ensure contact is made between the pair of spacer 24 and the twin limbs 100 to prevent damage to the twin limbs 100. The limb axle 10 may be fabricated from titanium, steel, aluminum, carbon fiber, plastic or any other suitable material or composite.

Figure 6:
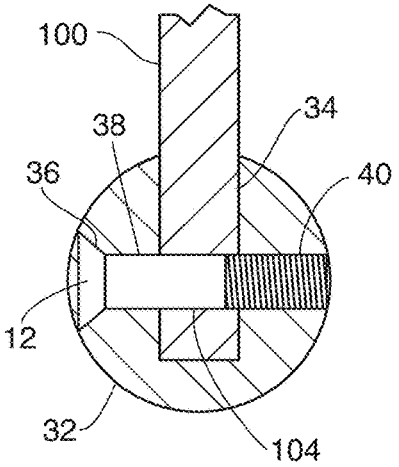
FIG. 6 is an enlarged cross sectional side view of a limb axle attached to twin limbs in accordance with the present invention.
Figure 7:
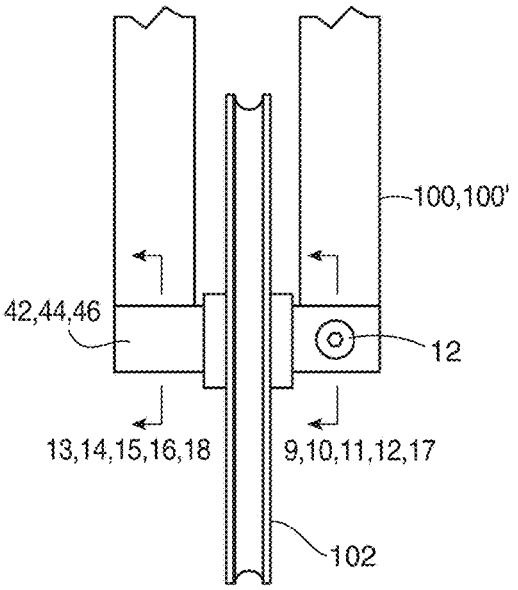
FIG. 7 is a top view of a tubular limb axle attached to a twin limb with a single fastener and adhesive in accordance with the present invention.
Figure 7A:
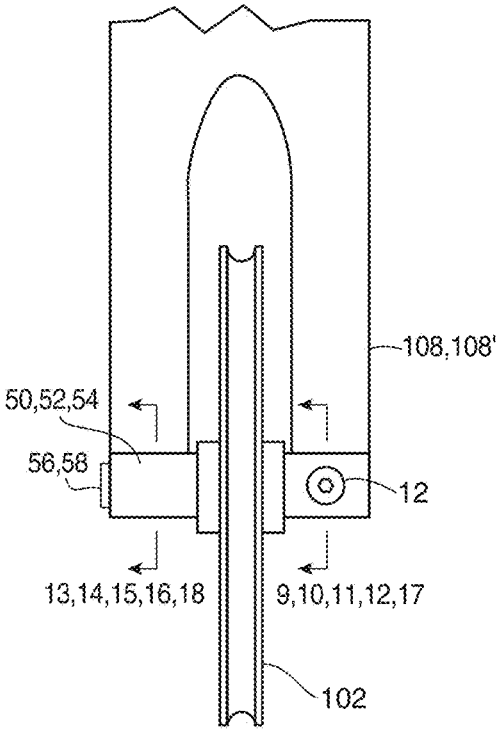
FIG. 7*a* is a top view of a tubular limb axle attached to a split limb with a single fastener and adhesive in accordance with the present invention.

With reference to FIG. 6, a non-tubular limb axle 32 includes a round outer diameter. The limb axle 32 is secured to end of the twin limbs 100 with the pair of fasteners 12. It is preferable to use a flat head screw to secure the limb axle 32 to the pair of limb members 100, but other fastening devices may also be used, such as rivets or pins. The archery cam 102, a pulley or the like is rotatably retained on the limb axle 32. An end pocket 34 is cut in opposing ends of the limb axle 32 to receive the pair of limb members. A countersunk hole 36 and a clearance hole 38 are formed through one side of the limb axle 32 to the end slot 34. Preferably, a threaded hole 40 is formed through an opposing side of the limb axle 32 to the end slot 34. The fastener 12 is inserted through the countersunk hole 36, the clearance hole 38 and the clearance hole 104 and tightened in the threaded hole 40. However, the threaded hole 40 may be replaced with a clearance hole, a longer fastener and a threaded nut. The limb axle 32 is fabricated from titanium, steel, aluminum or any other suitable material or composite.

Figure 14:
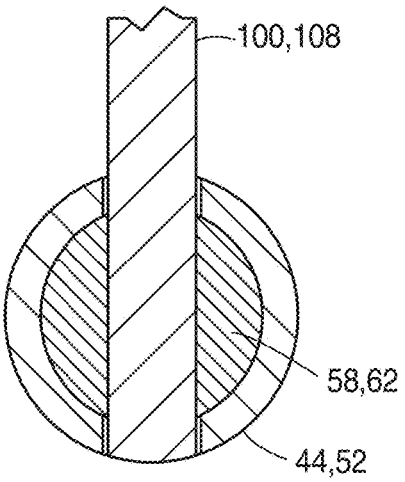
FIG. 14 is a cross sectional view of a tubular limb axle cut through FIG. 7 illustrating at least one spacer inside the tubular limb axle and a limb extending through a wall of the tubular limb axle in accordance with the present invention.
Figure 15:
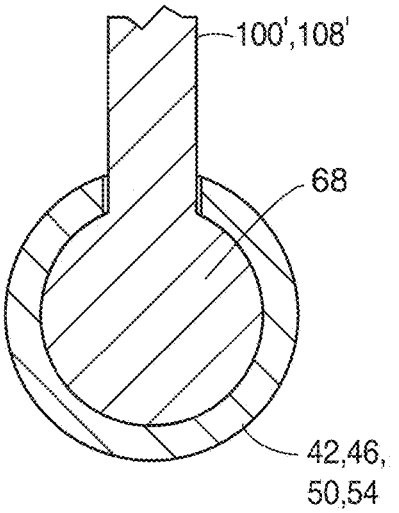
FIG. 15 is a cross sectional view of a tubular limb axle cut through FIG. 7 illustrating a modified limb end inside the tubular limb axle in accordance with the present invention.
Figure 16:
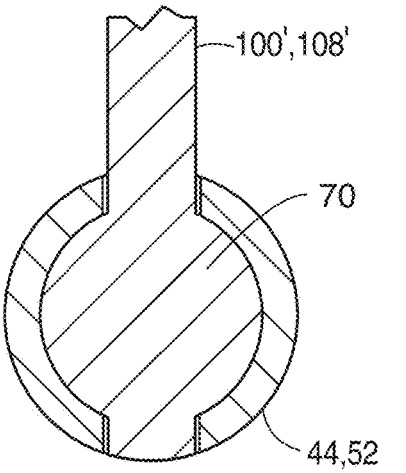
FIG. 16 is a cross sectional view of a tubular limb axle cut through FIG. 7 illustrating a modified limb end inside the tubular limb axle and a limb extending through a wall of the tubular limb axle in accordance with the present invention.
Figure 18:
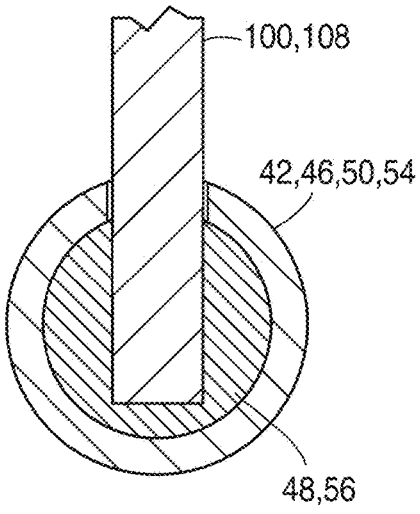
FIG. 18 is a cross sectional view of a tubular limb axle cut through FIG. 7 illustrating at least one spacer inside the tubular limb axle in accordance with the present invention.
Figure 20:
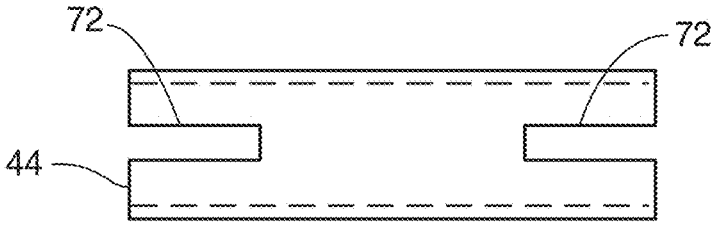
FIG. 20 is a rear view of a tubular limb axle with two limb slits formed through opposing walls in accordance with the present invention.
Figure 21:
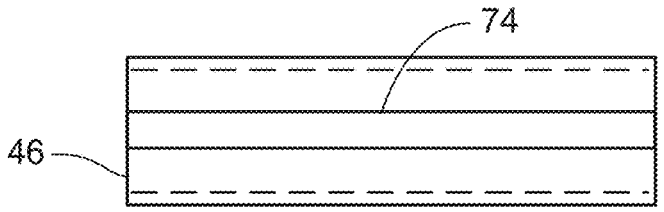
FIG. 21 is a rear view of a tubular limb axle with a single slit formed through a length of a single wall in accordance with the present invention.
Figure 22:
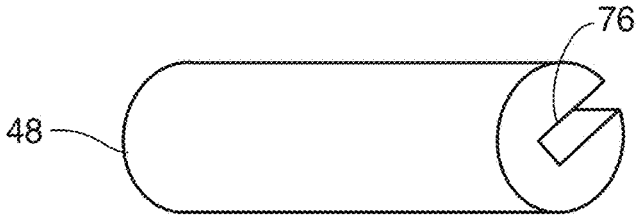
FIG. 22 is a perspective view of a one-piece spacer for a tubular limb axle in accordance with the present invention.
Figure 26:
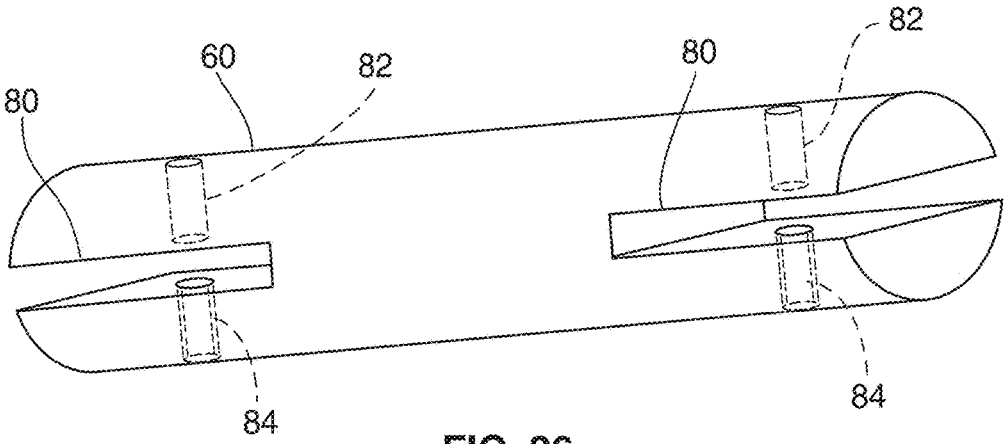
FIG. 26 is a perspective view of a double ended spacer for a tubular limb axle in accordance with the present invention.

With reference to FIGS. 7, 8, 13, 19, 21, 23, a limb axle 42, 46, and a spacer 62 are attached to one of the twin limbs 100 with an adhesive, glue, cement or any suitable bonding substance. With reference to FIGS. 14, 20, a limb axle 44 and a spacer 62 are attached to one of the twin limbs 100 with an adhesive, glue, cement or any suitable bonding substance. With reference to FIG. 18, the limb axle 42, 46 and a spacer 48 are attached to one of the twin limbs 100 with an adhesive, glue, cement or any suitable bonding substance. With reference to FIGS. 15, 22, 26, a spacer end 68 is formed on an and of the twin limb 100' or the split limb 108' to have the same cross sectional shape as one of the spacers 48, 56, 58, 60, 64, 66. The limb axle 42, 46 is attached to the spacer end 68 with the adhesive, glue, cement or any suitable bonding substance. With reference to FIG. 16, a spacer end 70 is formed on an end of the twin limb 100' or split limb 108' to have the same cross sectional shape as one of the spacers 48, 56, 58, 60, 64, 66. The limb axle 44 is attached to the spacer end 70 with the adhesive, glue, cement or any suitable bonding substance.

Figure 19:
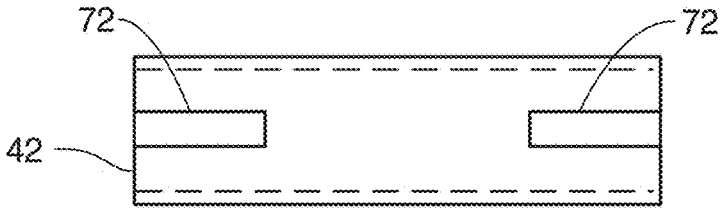
FIG. 19 is a rear view of a tubular limb axle with two limb slits formed through a single wall in accordance with the present invention.
Figure 23:
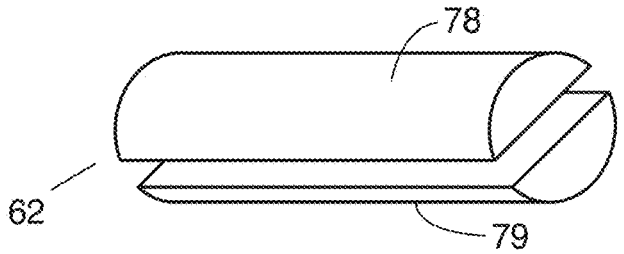
FIG. 23 is a perspective view of two spacers for a tubular limb axle in accordance with the present invention.

With reference to FIG. 19, the limb tube 42 is tubular and includes a pair of opposing slits 72 formed in opposing sides and through one wall thereof. The pair of opposing slits 72 are sized to receive the limbs 100, 100', 108 and 108'. With reference to FIG. 20, the limb tube 44 is tubular and includes a pair of opposing slits 72 formed in opposing sides and through opposing walls thereof. With reference to FIG. 21, the limb tube 46 is tubular and includes a lengthwise slot 74 formed through one wall and a length thereof. The lengthwise slot 74 is sized to receive the limbs 100, 100', 108 and 108'. With reference to FIG. 22, the spacer 48 includes a lengthwise slit 76. The lengthwise slit 76 is sized to receive the limbs 100, 100', 108 and 108'. A cross section of the spacer 48 is sized to be inserted into limb axles 42, 46. With reference to FIG. 23, the spacer 62 includes a first spacer portion 78 and a second spacer portion 79. The cross section of the spacer 62 is sized to be inserted into the limb axles 42, 44 and 46. With reference to FIG. 26, the spacer 60 includes a pair of opposing slits 80, a fastener clearance hole 82 and a threaded hole 84. The fastener clearance hole 82 and threaded hole 84 are formed over each opposing slit 80.

Figure 9:
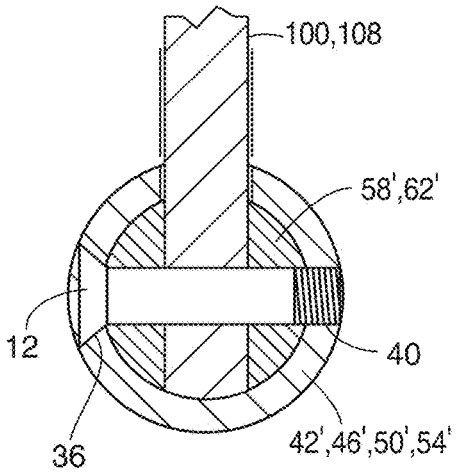
FIG. 9 is a cross sectional view of a tubular limb axle cut through a fastener in FIG. 7 illustrating at least one spacer inside the tubular limb axle in accordance with the present invention.
Figure 10:
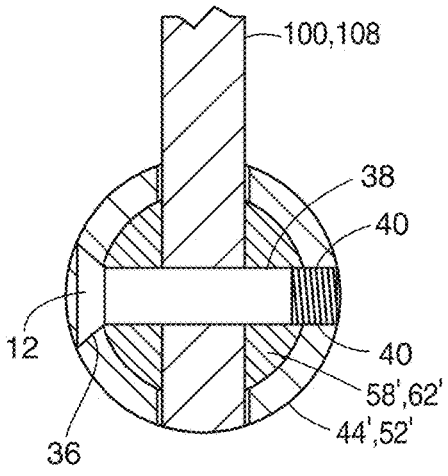
FIG. 10 is a cross sectional view of a tubular limb axle cut through a fastener in FIG. 7 illustrating at least one spacer inside the tubular limb axle and a limb extending through a wall of the tubular limb axle in accordance with the present invention.
Figure 17:
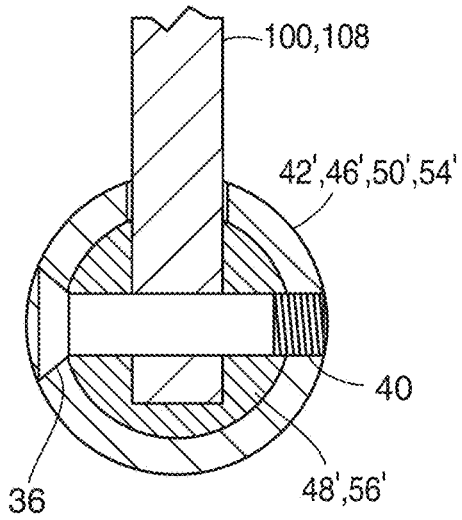
FIG. 17 is a cross sectional view of a tubular limb axle cut through a fastener in FIG. 7 illustrating a spacer inside the tubular limb axle in accordance with the present invention.

With reference to FIG. 9, the limb axle 42', 46' and the spacer 62' is attached to one of the twin limbs 100 or split limbs 108 with the fastener 12. With reference to FIG. 10, the limb axle 44' and the spacer 62' are attached to one of the twin limbs 100 or the split limbs 108 with the fastener 12. With reference to FIG. 17, the limb axle 42', 46' and the spacer 48' are attached to one of the twin limbs 100 or split limbs 108 with the fastener 12. The countersunk hole 36 is formed through one wall of the limb axles 42', 44', 46', 50', 52', 54'. The threaded hole 40 will be formed in the limb axles 42', 44', 46', 50', 52', 54' if a clearance hole 38 is formed through the spacer 48', 56', 58', 62'.

Figure 11:
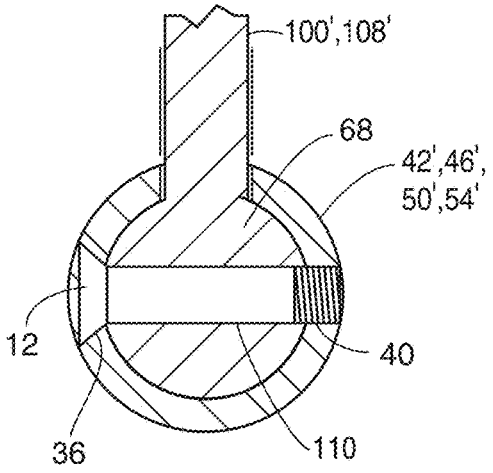
FIG. 11 is a cross sectional view of a tubular limb axle cut through a fastener in FIG. 7 illustrating a modified limb end inside the tubular limb axle in accordance with the present invention.
Figure 12:
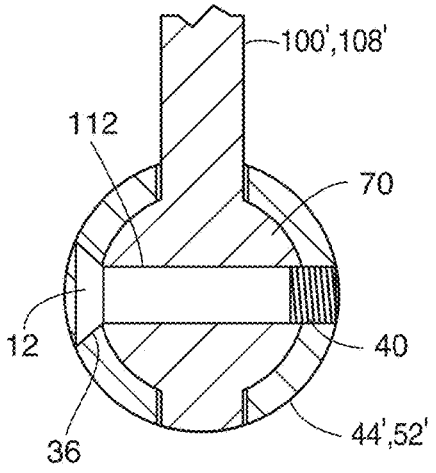
FIG. 12 is a cross sectional view of a tubular limb axle cut through a fastener in FIG. 7 illustrating a modified limb end inside the tubular limb axle and a limb extending through a wall of the tubular limb axle in accordance with the present invention.
Figure 13:
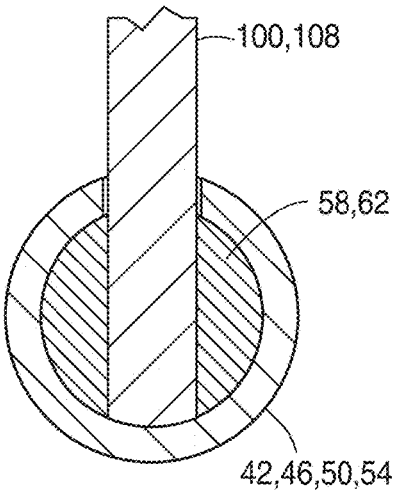
FIG. 13 is a cross sectional view of a tubular limb axle cut through FIG. 7 illustrating at least one spacer inside the tubular limb axle in accordance with the present invention.

With reference to FIG. 11, the spacer end 68 is formed on an end of the twin or split limb 100', 108' to have the same cross sectional shape as one of the spacers 48, 56, 58, 60, 64, 66. A clearance hole 110 is formed through the spacer end 68 to provide clearance for the fastener 12. The limb axle 42', 46' is attached to the spacer end 68 with the fastener 12. With reference to FIG. 12, the spacer end 70 is formed on an end of the twin or split limb 100', 108' to have the same cross sectional shape as one of the spacers 46, 56, 58, 60, 62 64. A clearance hole 112 is formed through the spacer end 70 to provide clearance for the fastener 12. The limb axle 46' is attached to the spacer end 70 with the fastener 12.

Figure 19A:
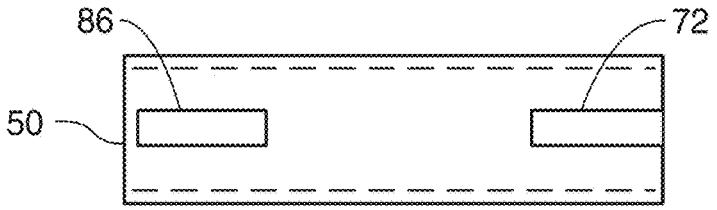
FIG. 19*a* is a rear view of a tubular limb axle with a slot and a slit formed through a single wall in accordance with the present invention.
Figure 20A:
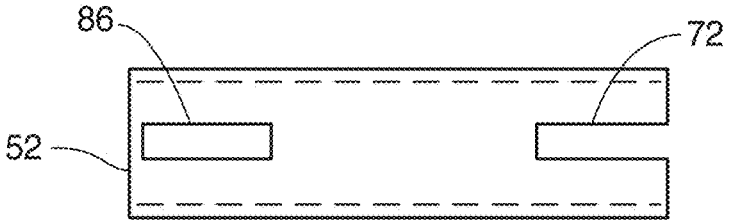
FIG. 20*a* is a rear view of a tubular limb axle with a slot and a slit formed through opposing walls in accordance with the present invention.
Figure 21A:
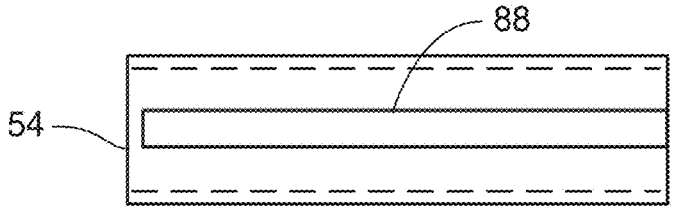
FIG. 21*a* is a rear view of a tubular limb axle with a single slit formed through substantially a length of a single wall in accordance with the present invention.
Figure 22A:
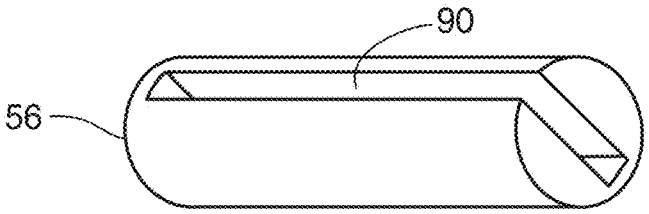
FIG. 22*a* is a perspective view of a one-piece spacer for a tubular limb axle in accordance with the present invention.
Figure 23A:
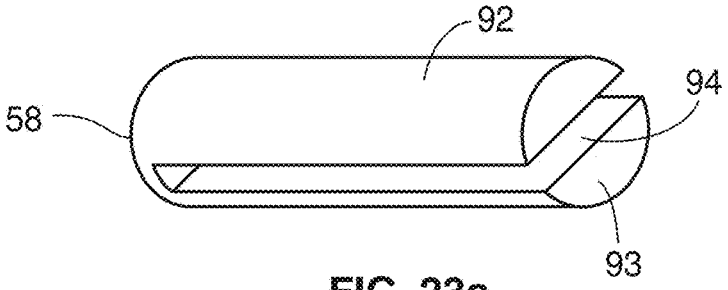
FIG. 23*a* is a perspective view of a one-piece spacer for a tubular limb axle in accordance with the present invention.

With reference to FIGS. 7*a*, 13, 19*a*, 20*a*, 21*a* and 23*a*, the limb axle 50', 52', 54' and a spacer 56', 58' are attached to one of the split limbs 108 with the fastener 12. With reference to FIG. 19*a*, the limb tube 50 is tubular and includes a slot 86 and the slit 72 formed in opposing sides and through one wall thereof. The slot 86 and the slit 72 are sized to receive the limb 108. With reference to FIG. 20*a*, the limb tube 52 is tubular and includes the slot 86 and the slit 72 formed in opposing sides and through both walls thereof. With reference to FIG. 21*a*, the limb tube 54 is tubular and includes a substantially lengthwise slot 88 formed through one wall and substantially a length thereof. The substantially lengthwise slot 88 is sized to receive the limbs 108 and 108'. With reference to FIG. 22*a*, the spacer 56 includes a substantially lengthwise slit 90. The substantially lengthwise slit 90 is sized to receive the limb 108. A cross section of the spacer 56 is sized to be inserted into limb axles 50, 54. With reference to FIG. 23*a*, the spacer 58 includes a first spacer portion 92 and a second spacer portion 93. A slot 94 is formed between the first and second spacer portions 92, 93. The cross section of the spacer 58 is sized to be inserted into the limb axles 50, 52 and 54.

With reference to FIGS. 9, 20*a*, the limb axle 52' and the spacer 58' are attached to one of the twin limbs 108 with the fastener 12. With reference to FIGS. 10, 19*a*, 21*a*, the limb axle 50', 54' and the spacer 58' are attached to one of the twin limbs 108 with the fastener 12. With reference to FIGS. 17, 19*a*, 21*a*, 22*a*, the limb axle 50', 54' and the spacer 56' are attached to one of the twin limbs 108 with the fastener 12. With reference to FIGS. 11, 19*a*, 21*a*, the limb axle 50', 54' is attached to the spacer end 68 of one of the twin limbs 108' with the fastener 12. With reference to FIGS. 12, 20*a*, the limb axle 52' is attached to spacer end 70 of one of the twin limbs 108' with the fastener 12.

Figure 8:
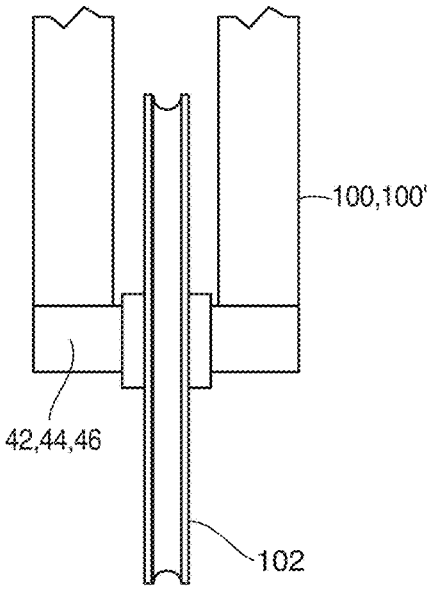
FIG. 8 is a top view of a tubular limb axle attached to a twin limb with adhesive in accordance with the present invention.
Figure 8A:
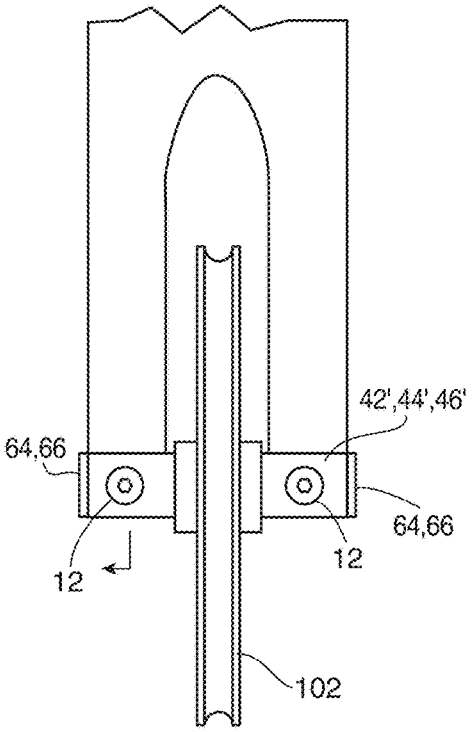
FIG. 8*a* is a top view of a tubular limb axle attached to a split limb with adhesive in accordance with the present invention.
Figure 17A:
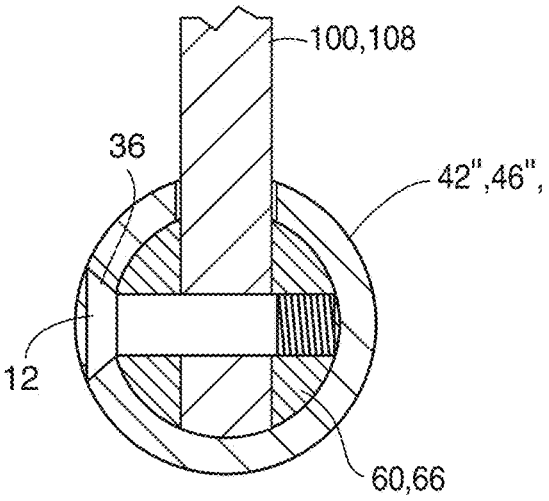
FIG. 17*a* is a cross sectional view of a tubular limb axle cut through a fastener in FIG. 8*a* illustrating a spacer inside the tubular limb axle in accordance with the present invention.
Figure 17B:
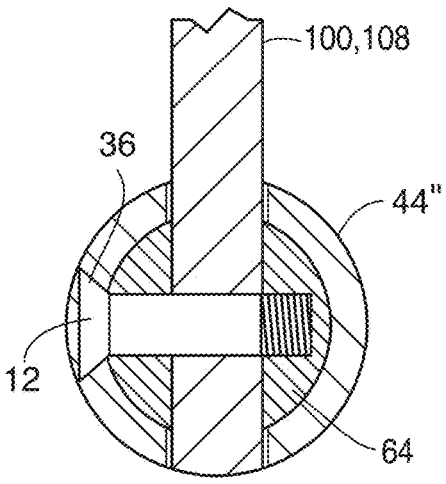
FIG. 17*b* is a cross sectional view of a tubular limb axle cut through a fastener in FIG. 8*a* illustrating a spacer inside the tubular limb axle, where the fastener threaded tap is blind in accordance with the present invention.
Figure 24:
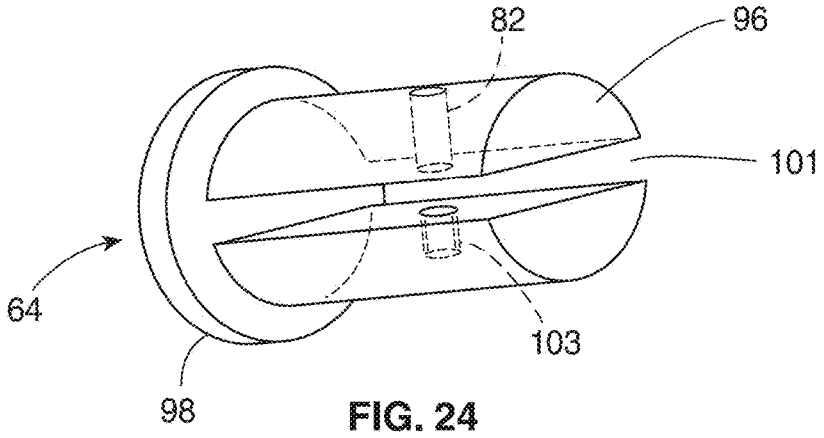
FIG. 24 is a perspective view of a one-piece spacer with a blind tap for a tubular limb axle for securement to a single limb portion in accordance with the present invention.
Figure 25:
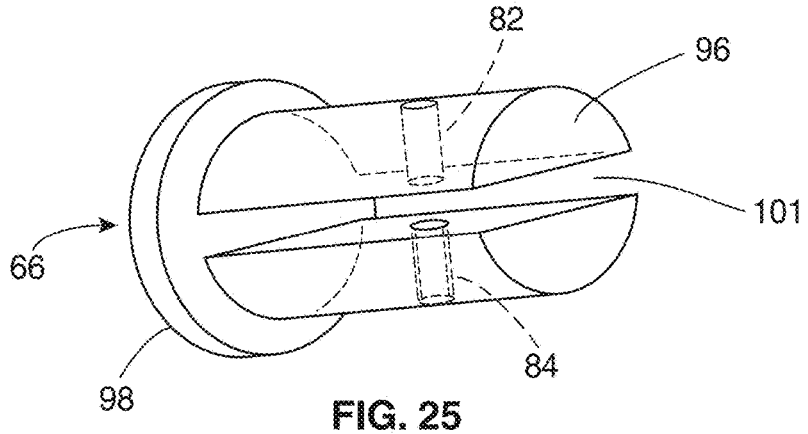
FIG. 25 is a perspective view of a one-piece spacer for a tubular limb axle for securement to a single limb portion in accordance with the present invention.

With reference to FIG. 24, the spacer 64 includes a spacer portion 96, a flange 98 and a substantially lengthwise slit 101. The fastener clearance hole 82 and a blind threaded hole 103 are formed in the spacer portion 96. With reference to FIG. 25, the spacer 66 includes the spacer portion 96, the flange 98 and the substantially lengthwise slit 101. The fastener clearance hole 82 and a threaded hole 84 are formed in the spacer portion 96. With reference to FIGS. 8*a*, 17*a*, 25, 26, the limb axle 42, 46 and the spacer 60, 66 are retained on one of the limbs 100, 108 with the fastener 12. With reference to FIGS. 8*a*, 17*b*, 24, the limb axle 44" and the spacer 64 are retained on one of the limbs 100, 108 with the fastener 12. With reference to FIGS. 8*a*, 17*a*, 25, the limb axle 42", 46" and the spacer 64 are retained on one of the limbs 100, 108 with the fastener 12.

The limb axles 42, 42', 44, 44', 46, 46', 50, 50', 52, 52', 54 and 54' include a centerline, which is located within a thickness of the limbs 100, 100', 108 and 108'. The spacers 48, 48', 56, 56', 58, 58', 60, 62, 62', 64 and 66 include slits or slots 76, 80, 90, 94, 100, which have opposing sides that are in direct contact with the limbs 100, 100', 108 and 108'.

While particular embodiments of the invention have been shown and described, it will be obvious to those skilled in the art that changes and modifications may be made without departing from the invention in its broader aspects, and therefore, the aim in the appended claims is to cover all such changes and modifications as fall within the true spirit and scope of the invention.

I claim:

1. A limb axle for attachment to one of twin limbs and a split limb, comprising:

an axle tube having a first end, a second end, an inner diameter and an outer diameter, an end slot is formed in each end of said axle tube, said end slot is sized to receive a thickness of the twin limbs or the split limb;

two spacers each include a flange, a spacer portion and a slit, said spacer portion extends outward from said flange, said slit is formed through a middle of said spacer portion, at least a portion of an outer perimeter of said spacer portion is in direct contact with said inner diameter of said axle tube, opposing sides of said slit of said spacer portion is in direct contact with a thickness of the twin limbs or the split limb; and two fasteners for securing said axle tube and said two spacers to the twin limbs or the split limb, wherein a first one of said two spacers is retained in a first end of said axle tube, a second one of said two spacers is retained in a second end of said axle tube.

2. The limb axle for attachment to one of twin limbs and a split limb of claim 1 wherein:

said end slot is formed through opposing walls of said axle tube.

3. The limb axle for attachment to one of twin limbs and a split limb of claim 1 wherein:

said end slot is formed through an entire length of said axle tube.

4. The limb axle for attachment to one of twin limbs and a split limb of claim 1 wherein:

an end flange is formed on an end of said two spacers.

5. The limb axle for attachment to one of twin limbs and a split limb of claim 1 wherein:

said fastener is a flat head screw.

6. The limb axle for attachment to one of twin limbs and a split limb of claim 1 wherein:

a countersunk hole is formed through one wall of said axle tube, a threaded hole is formed in said two spacers.

7. The limb axle for attachment to one of twin limbs and a split limb of claim 1 wherein:

said axle tube is fabricated from one of titanium, steel, aluminum, carbon fiber, plastic and composite material.

8. A limb axle for attachment to one of twin limbs and a split limb, comprising:

an axle tube having a first end, a second end, an inner diameter and an outer diameter, an end slot is formed in each end of said axle tube, said end slot is sized to receive a thickness of the twin limbs or the split limb;

a spacer having at least one slot, said at least one slot is sized to receive the twin limbs or the split limb, at least a portion of an outer perimeter of said spacer is in direct contact with said inner diameter of said axle tube, opposing sides of said at least one slot of said spacer are in direct contact with a thickness of the twin limbs or the split limb, wherein said axle tube is attached to said spacer and one of said twin limbs and said split limb with at least one threaded fastener or a bonding agent.

9. The limb axle for attachment to one of twin limbs and a split limb of claim 8 wherein:

said fastener is a flat head screw.

10. The limb axle for attachment to one of twin limbs and a split limb of claim 8 wherein:

a countersunk hole is formed through one wall of said axle tube, a threaded hole is formed in an opposing wall of said axle tube or said spacer.

11. The limb axle for attachment to one of twin limbs and a split limb of claim 1 wherein:

a centerline of said axle tube is located within a thickness of the twin limbs or the split limb.

* * * * *